US006608909B2

(12) United States Patent
Brady

(10) Patent No.: US 6,608,909 B2
(45) Date of Patent: Aug. 19, 2003

(54) FOLDABLE SPEAKER RACK FOR USE WITH SPAS

(76) Inventor: James P. Brady, 305 W. Maple Ave., Orange County, CA (US) 92866

( * ) Notice: Subject to any disclaimer, the term of this patent is extended or adjusted under 35 U.S.C. 154(b) by 0 days.

(21) Appl. No.: 09/912,815

(22) Filed: Jul. 24, 2001

(65) Prior Publication Data

US 2003/0019986 A1 Jan. 30, 2003

(51) Int. Cl.[7] ..... H04R 1/02

(52) U.S. Cl. ..... 381/387; 381/87; 381/390; 248/176.3; 248/284.1; 211/172; 211/206

(58) Field of Search ..... D14/224, 204, D14/221; 381/386, 387, 390, 87, 332, 333, 334, 335, 336, 388, 389, 361, 362; 248/176.1, 176.3, 251, 276.1, 284.1, 291.1, 288.11, 289.11, 282.1, 278.1, 290.1; 211/26, 144, 170, 171, 172, 206; D12/223, 406; 455/350; 181/141; 224/441, 443, 444

(56) References Cited

U.S. PATENT DOCUMENTS

| | | | | | |
|---|---|---|---|---|---|
| 1,734,522 | A | * | 11/1929 | Kauffman | 248/103 |
| 2,166,989 | A | * | 7/1939 | Gleason | 248/251 |
| 2,409,152 | A | * | 10/1946 | Rundell | 16/338 |
| 2,527,656 | A | * | 10/1950 | Reinsdorf | 381/388 |
| 2,645,446 | A | | 7/1953 | Ulrich | 16/342 |
| 2,653,002 | A | * | 9/1953 | Passman | 248/289.11 |
| 2,701,114 | A | * | 2/1955 | Donaldson | 16/445 |
| 2,766,330 | A | * | 10/1956 | Olsen | 248/276.1 |
| 3,098,128 | A | * | 7/1963 | Audin | 381/388 |
| 3,233,745 | A | | 2/1966 | Hershberger | 211/104 |
| 3,385,929 | A | | 5/1968 | Magyar et al. | 181/145 |
| 3,585,991 | A | | 6/1971 | Balamuth | 310/334 |
| 3,788,642 | A | * | 1/1974 | Matras et al. | 248/291.1 |
| 3,976,162 | A | | 8/1976 | Cummings | 181/141 |
| 4,061,877 | A | | 12/1977 | Phillips | 381/301 |
| 4,063,704 | A | * | 12/1977 | Rother | 211/70.8 |
| 4,075,438 | A | * | 2/1978 | Kappel | 381/301 |
| 4,101,107 | A | * | 7/1978 | Antoszewski | 248/218.4 |
| 4,113,218 | A | | 9/1978 | Linder | 248/124.1 |
| 4,392,627 | A | * | 7/1983 | van den Broek | 248/176.1 |
| 4,445,228 | A | * | 4/1984 | Bruni | 381/302 |
| 4,475,226 | A | | 10/1984 | Greenberg | 362/370 |
| D281,317 | S | * | 11/1985 | Whitaker | D14/224 |
| 4,575,882 | A | | 3/1986 | Diamond | 4/559 |
| 4,753,408 | A | | 6/1988 | Wailes | 108/145 |
| 4,880,196 | A | | 11/1989 | Eichenlaub | 248/165 |
| 4,928,914 | A | | 5/1990 | Snodell | 248/284.1 |
| 4,964,181 | A | | 10/1990 | Alpert | 4/597 |
| 4,974,759 | A | * | 12/1990 | McDonough | 224/443 |
| 5,127,617 | A | * | 7/1992 | Bergetz | 108/48 |
| 5,201,896 | A | | 4/1993 | Kruszewski | 248/278.1 |
| 5,282,251 | A | * | 1/1994 | Petersen | 381/333 |

(List continued on next page.)

FOREIGN PATENT DOCUMENTS

| | | | | |
|---|---|---|---|---|
| FR | 2410766 A2 | * | 6/1979 | 248/291.1 |

*Primary Examiner*—Ramon O. Ramirez
*Assistant Examiner*—Jon Szumny
(74) *Attorney, Agent, or Firm*—Cislo & Thomas LLP

(57) ABSTRACT

A speaker rack for use with spas including a first and second member with the second member comprising generally extending members. The first member is coupled to the generally extending members of the second member. This first member allows for support, helps an individual move the speaker rack into different positions easily and acts as a place to hang towels, clothing and the like. Multi-position detents attach to the second member and allow for the speaker rack to be placed in an extreme upward position, an extreme downward position and positions in between. Speakers that can be swivel and pivotally mounted attach to speaker attachment means on the generally extending members of the second member and speaker wiring may run through an aperture in the second member and attach to an output device allowing for entertainment while in or around the spa.

2 Claims, 3 Drawing Sheets

U.S. PATENT DOCUMENTS

| | | | | | |
|---|---|---|---|---|---|
| D369,806 | S | * | 5/1996 | Ichikawa | D14/172 |
| D376,093 | S | | 12/1996 | Whitaker et al. | D8/349 |
| D395,892 | S | | 7/1998 | Solomon | D14/224 |
| 5,802,194 | A | * | 9/1998 | Yamagishi et al. | 181/144 |
| 5,889,875 | A | * | 3/1999 | Caron et al. | 381/338 |
| 5,947,434 | A | | 9/1999 | Kosmoski et al. | 248/221.11 |
| 6,015,132 | A | | 1/2000 | Belle | 248/205.3 |
| D434,028 | S | | 11/2000 | DeFazio | D14/224 |
| 6,157,729 | A | | 12/2000 | LeBlanc | 181/141 |
| D451,495 | S | * | 12/2001 | McGurty | D14/214 |
| D451,880 | S | * | 12/2001 | Adams et al. | D12/406 |
| 6,345,797 | B1 | * | 2/2002 | Ming-Hsiao | 211/105.1 |

* cited by examiner

FOLDABLE SPEAKER RACK FOR USE WITH SPAS

BACKGROUND OF THE INVENTION

1. Field of the Invention

This invention relates generally to speaker assemblies, and more specifically to speaker racks that are foldable for use with spas.

2. Description of the Related Art

Combining audio entertainment with whirlpool bathtubs or spas is known in the art. Also, the dangers involved in having electrical equipment near water are well known. For many individuals that have separate spas, who desire to have audio entertainment while relaxing in these spas, a solution lies in the transport of a portable stereo system. Problems arise with this scenario, such as the proximity of electrical equipment to an amount of water in which a user remains and proximity to an electrical source for such equipment. Also, for those who might use battery power for such electrical equipment, the length of time that power will last as well as the increasing cost or inconvenience to consistently replace or recharge said battery power can be a substantial issue. Yet another issue involved is the storing of the electrical equipment, which will require some further transportation of this electrical equipment, possibly while the user is still damp from the spa water.

In existing embodiments of spa entertainment, holes are cut into the spa shell and the speakers and audio equipment are placed within. Problems arise with the manufacturer because there is a need to retool the mold in order to make room for the speakers and other audio equipment, which in turn creates additional problems, such as increased manufacturing costs. Shipping these spa shells also becomes a problem because of the odd shapes created in the spa shell itself. Also, retooling the mold creates inefficiencies for the spa manufacturers by destroying the consistency of the spa shell shape. Not only will buyers will be limited in the selection of these newly molded shells, but problems in the aftermarket will be created.

Mountable speaker systems and mounting brackets for speakers are well known in the art. Speaker assemblies are available that correspond to solving specific problems or have special features, such as speaker devices for the hearing impaired and surround sound speaker systems. These speaker systems, however, do not allow for easy storage nor do they have the ability to be used in conjunction with a variety of different spas.

Therefore what is needed in the art is a speaker rack that eliminates all the inconveniences of special mold manufacturing, eliminates unnecessary additional costs for the spa manufacturer, is easily adjustable, allows for all of the audio equipment to be housed outside of the spa environment, has simple storage means and can be used in conjunction with a variety of spas, regardless of size or shape.

SUMMARY OF THE INVENTION

The present invention includes a first transverse member and a second support member that further includes oppositely opposed first and second generally extending members. The first transverse member couples to and extends between the oppositely opposed generally extending members of the second support member and one or more positioning members couple to the second support member allowing for securing the members into an extreme upward, an extreme downward and positions in between. The one or more positioning members, which can be multi-position detents, either attach to the spa itself, to attachment means on the spa or to an independent standing means. The oppositely opposed generally extending members have speaker attachment means allowing for speakers to be swivel and pivot mounted. The first transverse member allows for towels, clothing or the like to be hung while using the spa and both the first transverse member and second support member may allow for telescopic movement so that adjustments can be made to the spacing between the speakers allowing for use with different sized and shaped spas. The first transverse member, second support member and oppositely opposed first and second generally extending members include apertures allowing speaker wire to run through and connect to an input or output device. The present invention may include a housing unit and a table element. The table element, which may include engagement means for easy maneuverability, connects to the first transverse member while the housing unit connects to the spa and can surround the second support member. The housing unit includes apertures allowing the speakers to rest inside while in the extreme downward position.

OBJECTS OF THE INVENTION

It is an object of the present invention to provide an easily adjustable and easily storable speaker rack for use with spas or the like.

It is a further object of the present invention to provide a location near the spa for the placement of beverages, hanging of towels and clothing or the like.

It is an further object of the present invention to provide both an easily adjustable and easily storable speaker rack for use with spas and to provide a location near the spa for the placement of beverages, hanging of towels and clothing or the like.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
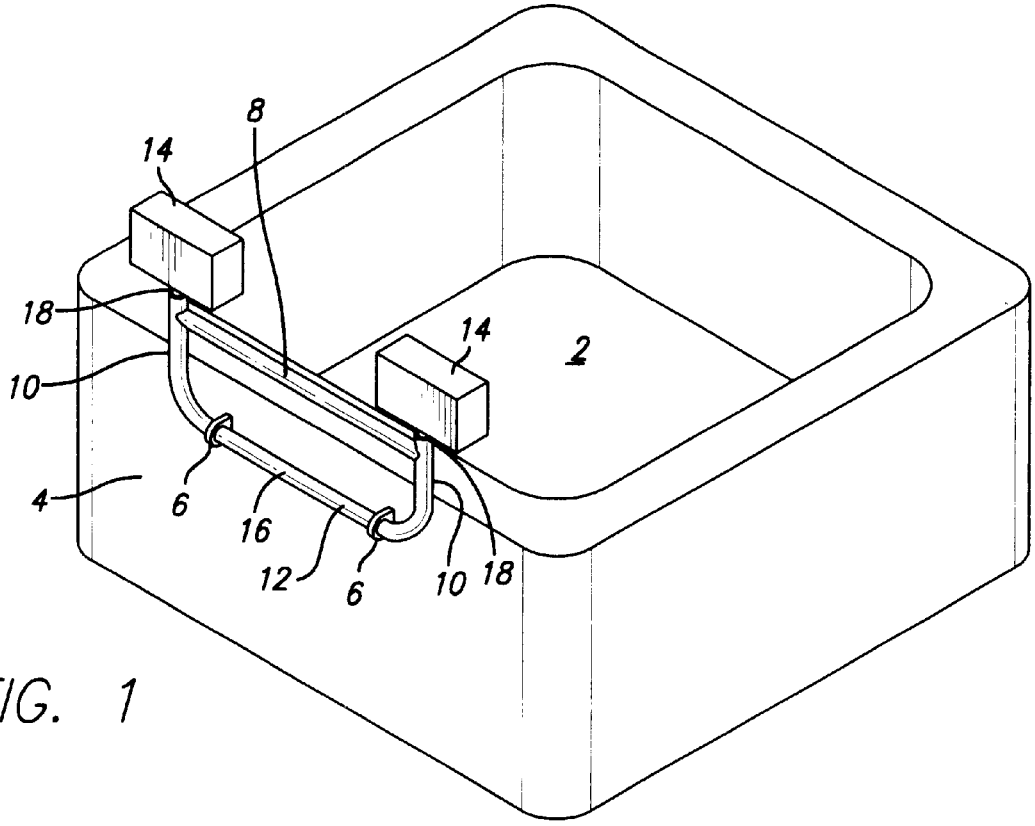
FIG. 1 is a rear perspective view of the present invention shown in its extreme upward position while attached to a spa.

FIG. 1 shows a spa 2 comprising the present invention in its extreme upward position or operational position. The present invention can attach to the any face 4 of the spa 2 by way of spa attachment means or one or more positioning members or multi-position detents 6 that can be securely attachable to the spa or to spa attachment means. The two multi-position detents 6 allow the present invention to be secured in up, down or any position in between. A transverse member 12 or assembly element, adaptable to a spa 2 for association thereto, having a diverging end 10 from its axis and a second opposite diverging end 11 can be movably held in either an upright or folded position. The diverging ends 10, 11 or oppositely and opposing first and second generally extending members, are adaptable for association with speakers. A support member 8 used for allowing a convenient location for hanging towels, clothing and the like, securely attaches to and extends between the diverging ends 10, 11 of the transverse member 12. In the present invention, the diverging ends 10, 11 curve in an upward direction, although this is not required. A user pulling on the support member 8 can easily adjust and secure the present invention into many different positions in between the extreme upward and downward position, by the two multi-position detents 6. The transverse member 12 pivotally couples to the multi-position detents 6, which can attach to the spa 2, to attachment means on the spa 2 or to an independent standing means (not shown) not attached to the spa 2.

The diverging ends 10, 11 of the transverse member 12 include speaker attachment means 18. The speaker attachment means 18 on the diverging ends 10, 11 may have swivel and pivot capabilities. The first and second speakers 14 shown in FIG. 1 are rectangular, however any size or shaped speakers 14 may be used in conjunction with the present invention. These first and second speakers 14 can couple to the speaker attachment means 18 such that the speakers 14 have the ability to swivel and pivot. Inside the transverse member 12, there exists space allowing speaker wiring (not shown) to pass through and the transverse member 12 may contain an aperture 16 allowing speaker wiring to exit the transverse member 12 and connect to input or output devices (not shown). Although not necessary, it is preferable to run speaker wiring in a zig-zag pattern in order to avoid any pulling on the first and second speakers 14 when the present invention is moved into different positions.

The support member 8 and transverse member 12 may have the ability to extend. In this instance, the support member 8 and transverse member 12 can telescopically extend, thereby allowing the distance between the first and second speakers 14 to be adjustable. In this embodiment, the support member 8 and transverse member 12 may comprise metal tubing, aluminum tubing, PVC tubing or various other materials with similar properties may be used.

Figure 2:
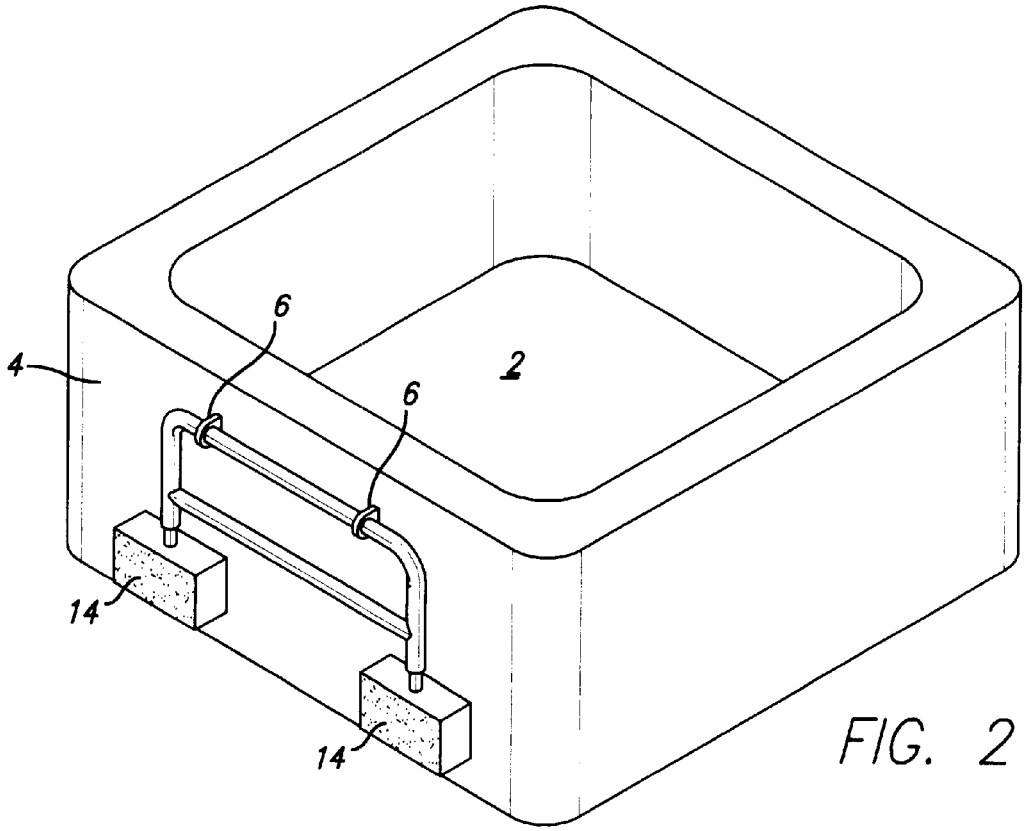
FIG. 2 is a rear perspective view of the present invention shown in its extreme downward position while attached to a spa.

FIG. 2 shows the present invention in the extreme downward position or retracted position. Besides the extreme upward and extreme downward position, the multi-position detents 6 can also allow the present invention to be positioned into many secure positions in between. When the present invention is in the extreme downward position, the first and second speakers 14 are allowed to project in a generally opposite direction from its operational position, allowing for audio entertainment to be heard outside of the spa 2, such as when a user is not located in the spa 2, but in the surrounding area.

Figure 3:
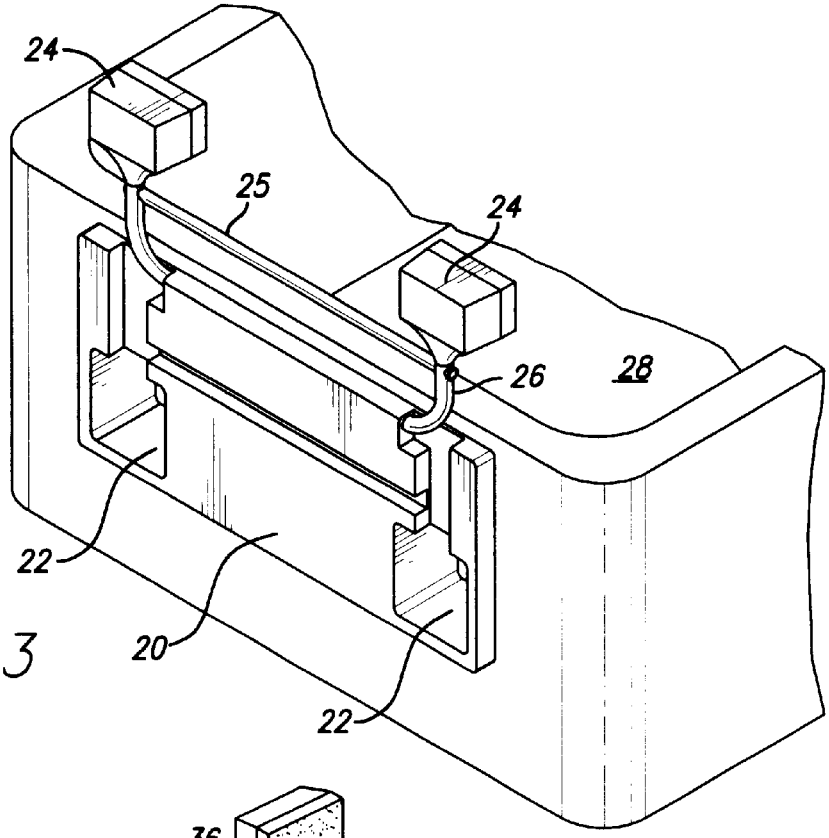
FIG. 3 is a rear perspective view of another embodiment of the present invention shown in its extreme upward position while attached to a spa.

FIG. 3 represents another embodiment of the present invention in the extreme upward position. In this embodiment, a housing unit 20 having apertures 22 couples to the spa 28 and surrounds the transverse member (not shown) and multi-position detents (not shown) allowing the first and second speakers 24 and support member 25 to fit inside the apertures 22 of the housing unit 20 when in the extreme downward position. In the extreme upward position, the first and second speakers 24 face in a direction toward the inside of the spa 28, but can be swivel and pivot mounted on the oppositely opposing first and second generally extending members 26 allowing for the first and second speakers 14 to be in many positions in relation to the inside of the spa 28. When in the extreme downward position, the first and second speakers 24 rest inside the corresponding apertures 22 and can face outward allowing for audio entertainment in the area surrounding the spa 28. Also, in the extreme upward position, the support member 25 can be used as a rack for towels, clothing or the like. Other apertures (not shown) can exist in the housing unit 20 in order to provide space for a radio, receiver and/or inverter, keeping the audio system outside of the spa environment. The housing unit 20 can comprise of a molded plastic, foam or other similar materials.

Figure 4:
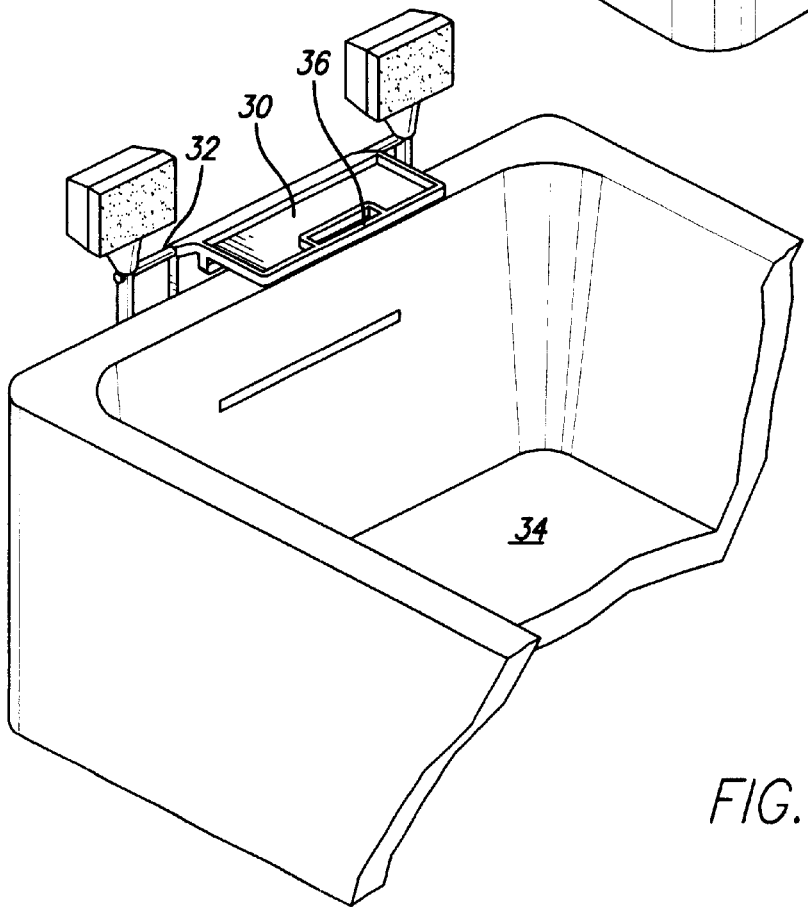
FIG. 4 is a front perspective view of another embodiment of the present invention shown in its extreme upward position while attached to a spa
Figure 5:
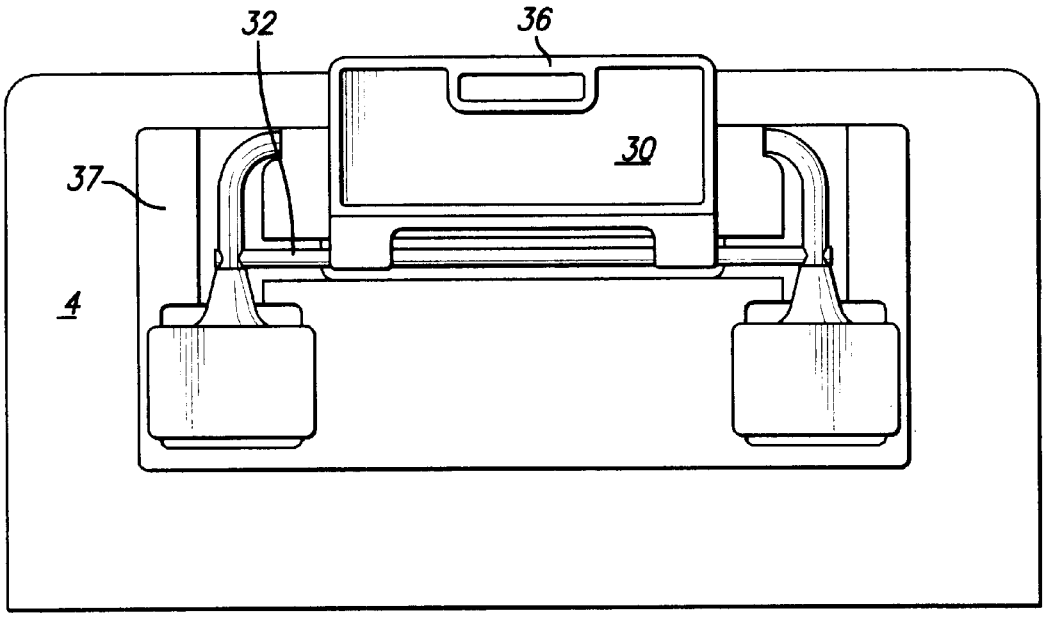
FIG. 5 is a front view of the embodiment of the present invention as shown in FIG. 4, shown in its extreme downward position while attached to a spa.

In FIGS. 4 and 5, yet another embodiment of the present invention is shown. FIG. 4 shows the embodiment in the extreme upward position and FIG. 5 in the extreme downward position. A table element 30 couples to the support member 32 and in an extreme upward position, drinks and the like can be placed on the table element 30 while the individuals are inside or outside of the spa 34. The table element 30 may contain an engagement member 36 allowing a user a simpler method to move the present invention into different positions. Also, the table element 30 may be securely attached to the support member 32 or may have swiveling capabilities allowing the table element 30 to be moved from the inside to the outside of the spa 34, while in the extreme upward position. In the downward position, the table element 30 folds neatly against the housing unit 37.

Figure 6:
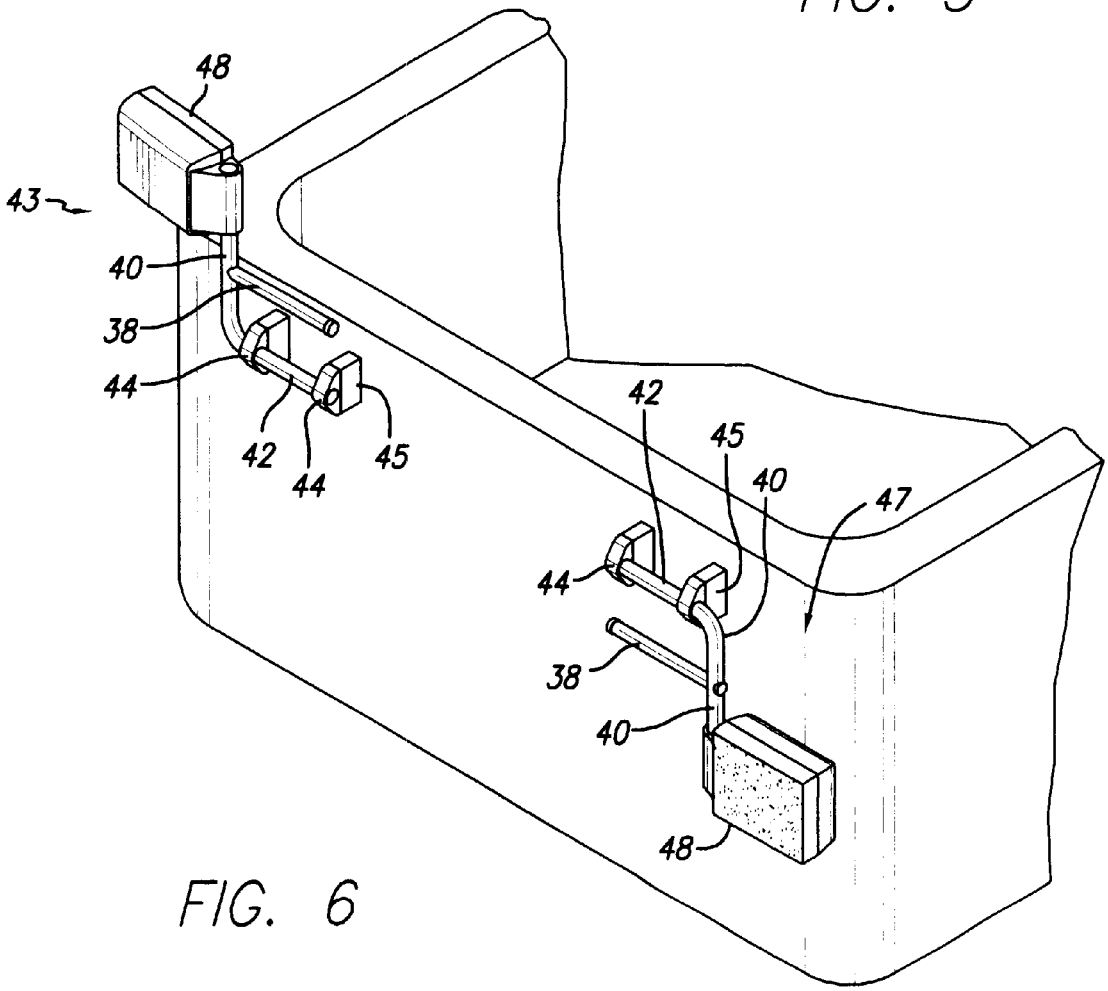
FIG. 6 is a rear perspective view of yet another embodiment of the present invention.

FIG. 6 represents yet another embodiment of the present invention. In this embodiment, a support structure 41 having a base 42 and at least one extending portion or a generally extending member 40 having an end adaptable to receive a speaker 48. A support member 38 couples to the generally extending member 40 of the support structure 41. The base 42 can be pivotally coupled to one or more multi-position detents 44, which can be coupled to the spa 46 itself, to spa attachment means 45 or to an independent standing means (not shown). The support member 38 can be used as a towel rack or the like as well as a handle for a user to position the present invention in the extreme upward, extreme downward or positions in between. This embodiment can allow for a plurality of these embodiments coupled to the spa 46, allowing one to be in an extreme upward position 43 or erected position for best audio sound to a user in the spa 46, while another is in the extreme downward position 47 or folded position for best audio sound for a user outside the spa 46. The base 42 can be mounted as shown in FIG. 6, but can also be mounted such that the base 42 and generally extending member 40 form a reverse L position so that the speaker 48 rests on the other side of the multi-position detents 44. The present embodiment is preferable when there are some guests using the spa 46 as well as other guests not using the spa, but located in the surrounding area.

While the present invention has been described with regards to particular embodiments, it is recognized that additional variations of the present invention may be devised without departing from the inventive concept.

What is claimed is:

1. A foldable speaker rack for use with a spa comprising:

a transverse member and a support member;

said support member comprising oppositely opposed first and second generally extending members;

said transverse member coupled to and extending between said first and second generally extending members of said support member, said oppositely opposed first and second generally extending members comprising speaker attachment means;

a first speaker, said first speaker coupled to said speaker attachment means on said first generally extending member;

a second speaker, said second speaker coupled to said speaker attachment means on said second generally extending member;

said first and second speakers swivel and pivotally couple to said speaker attachment means on said first and second generally extending members;

said one or more positioning members comprise multi-position detents;

said transverse member and said support member having the ability to telescopically extend;

whereby said speaker rack can be secured in an upward position, a downward position or a position in between.

2. A foldable speaker rack for use with a spa comprising:

a spa, a transverse member, and a support member mounted to said spa;

said support member comprising oppositely opposed first and second generally extending members;

said transverse member coupled to and extending between said first and second generally extending members of said support member;

said oppositely opposed first and second generally extending members comprising speaker attachment means;

a first speaker, said first speaker coupled to said speaker attachment means on said first generally extending member;

a second speaker, said second speaker coupled to said speaker attachment means on said second generally extending member;

said first and second speakers swivel and are pivotally coupled to said speaker attachment means on said first and second generally extending members;

said transverse member and said support member having the ability to telescopically extend;

whereby said speaker rack can be secured in an upward position, a downward position to project in generally the opposite direction, or a position in between in relation to said spa.

* * * * *